US009285186B1

(12) United States Patent
Di Veroli et al.

(10) Patent No.: US 9,285,186 B1
(45) Date of Patent: Mar. 15, 2016

(54) MODULAR SIGHT SYSTEM, BACK PLATE RECEPTACLE AND INTERCHANGEABLE DEVICES FOR GUNS

(71) Applicants: Oscar Di Veroli, Plantation, FL (US); Adam Wayne Di Veroli, Plantation, FL (US); Justin Ryan Klosenberg, Pembroke Pines, FL (US); Jesse Berger, Boca Raton, FL (US)

(72) Inventors: Oscar Di Veroli, Plantation, FL (US); Adam Wayne Di Veroli, Plantation, FL (US); Justin Ryan Klosenberg, Pembroke Pines, FL (US); Jesse Berger, Boca Raton, FL (US)

( * ) Notice: Subject to any disclaimer, the term of this patent is extended or adjusted under 35 U.S.C. 154(b) by 0 days.

(21) Appl. No.: 14/515,077

(22) Filed: Oct. 15, 2014

(51) Int. Cl.
*F41G 1/06* (2006.01)
*F41G 1/32* (2006.01)

(52) U.S. Cl.
CPC ... *F41G 1/06* (2013.01); *F41G 1/32* (2013.01)

(58) Field of Classification Search
CPC ..... F41G 1/06; F41G 1/32; F41G 1/08; F41G 1/10; F41G 1/12; F41G 1/14; F41G 1/16; F41G 1/17; F41G 1/20; F41G 1/22; F41G 1/26; F41G 1/28
USPC ..... 42/111, 135, 136, 137, 138, 148
See application file for complete search history.

(56) References Cited

U.S. PATENT DOCUMENTS

| | | | | |
|---|---|---|---|---|
| 3,187,436 | A | 6/1965 | Friedrichsmeier | |
| 3,748,744 | A | 7/1973 | McClenahan | |
| 4,628,611 | A | 12/1986 | Ruffino | |
| D435,625 | S | 12/2000 | Ling, Jr. | |
| 6,493,978 | B1 | 12/2002 | Perkins | |
| 7,506,469 | B2 | 3/2009 | Poulin et al. | |
| 8,191,301 | B2 * | 6/2012 | Hatfield | F41A 19/34 42/90 |
| 8,448,373 | B2 | 5/2013 | Matthews et al. | |
| 8,468,734 | B2 * | 6/2013 | Meller | F41A 3/72 42/71.02 |
| 2004/0200109 | A1 * | 10/2004 | Vasquez | F41A 19/01 42/1.01 |
| 2011/0154710 | A1 * | 6/2011 | Hatfield | F41C 27/00 42/90 |
| 2012/0000108 | A1 | 1/2012 | Zusman | |
| 2013/0000173 | A1 * | 1/2013 | Green | F41A 17/64 42/70.11 |
| 2013/0111799 | A1 * | 5/2013 | Lee | F41G 11/001 42/106 |
| 2013/0219766 | A1 | 8/2013 | Lee | |
| 2014/0298703 | A1 * | 10/2014 | Gale | F41C 27/00 42/71.02 |

OTHER PUBLICATIONS

Strike Industries Glock Rear Sight Rail, http://www.recoilweb.com/Strike-industries-glock-rear-sight-rail-20085.html; Jan. 14, 2014.*
Strike INdustries Rear Sight Mount Manual; http://strikeindustries.com/shop/manual/Glock_Rail_adapter_manual_1.pdf.*

* cited by examiner

*Primary Examiner* — Joshua Freeman
(74) *Attorney, Agent, or Firm* — Malin Haley DiMaggio & Bowen, P.A.

(57) ABSTRACT

A modular rear sight system, back plate receptacle, and interchangeable sight devices for guns are disclosed. The modular sight system includes a replacement back plate receptacle for guns having a slide with a rear sight and rear back plate section for receiving a cover plate. The back plate receptacle has a mounting base that is compatible with, and fits within, the slide back plate section, and also incorporates an attachment receptor. The attachment receptor receives interchangeable sight members with vertical runway sight features. Interchangeable and fixed sight inserts of various designs enhance optics, visual memory, target acquisition, gun speed, handling and accuracy.

12 Claims, 25 Drawing Sheets

MODULAR SIGHT SYSTEM, BACK PLATE RECEPTACLE AND INTERCHANGEABLE DEVICES FOR GUNS

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

1. Field of the Invention

The present invention generally relates to sight systems for guns, and more particularly to and advanced modular sight which utilizes a novel back plate receptacle that replaces the original equipment manufacturers' back plate and has design features which accept interchangeable sight devices enhancing optics and sight-to-target efficiencies.

2. Description of Related Art

As is well appreciated in the art of weaponry and particularly rifles and hand guns, there have been numerous attempts to develop more efficient, accurate and user friendly sight systems. However, many may involve mechanisms, hardware, and/or components which may be obtrusive, awkward in operation or use, or which interfere with the natural handling or sighting of the gun. Furthermore, the gun industry has largely overlooked the problems, functionality, and modular sight system addressed and developed by Applicants, and most particularly modular and interchangeable sight devices and the novel "runway" system described hereinafter.

For example, U.S. Pat. No. 8,448,373, entitled Gun Sight and issued to Matthews, et al., discloses an apparatus adapted to be mounted about the rear end of the gun, and positioned to occlude one eye of the user and generate an illuminated dot, which is centered on the longitudinal axis of the barrel of the gun. Both refractive and reflective methods can be utilized to produce a beam of light that creates the image of an illuminated dot, and the user adjusts the position of the gun relative to the target until it is perceived that the dot of the sight is positioned on the target.

The U.S. Pat. No. 4,628,611, entitled Rear Gun Sight and issued to Ruffino, illustrates an elongated sight body having elongated front legs with a forward sight body recoil shoulder, a sliding sight blade which permits windage adjustment, and a method for pivotally attaching the sight body to the gun frame to permit elevation adjustment. Interacting components are meant to bear and reduce the impact of a gun's recoil.

The U.S. Pat. No. 3,748,744, entitled Adjustable Rear Sight for Handguns and issued to McClenahan, teaches an adjustable rear sight pivotably mounted within a slot opening to the rear of the gun frame itself. The pivot access includes a spring biased against the side of the base and a second pin threaded to the gun frame such that the second pin controls the lateral position of the gun sight for windage adjustment. A vertically positioned screw engages the bottom of the slot such that movement of this screw will control elevation adjustment.

Furthermore, U.S. Pat. No. 3,187,436, entitled Contrasting Color Gun Sight and issued to Friedrichsmeier, describes a gun sight system in which a front sight includes two vertically aligned longitudinal passageways with the upper passageway including a colored insert at its forward end, and a rear sight including a longitudinal passageway having a color insert, the rear sight being aligned with the front sight enabling the user the gun to position the rear insert "in line" with the lower passageway of the front sight so that the inserts of both the front and rear sights appear in vertical alignment thereby ensuring the absence of any undesirable tilting or canting of the weapon.

However, the representative art and conventional gun sights do not relate to the enhanced modular runway sight system with interchangeable components, all providing for superior speed and accuracy in handling guns, and precision visual-motor coordination skills.

Accordingly, there is a need in the art for a more accurate, efficient and user friendly sight system for guns, one that allows for use of different sight components, and increases gun alignment, speed in target acquisition, and improved optical aiming functions. It is, therefore, to the effective resolution of the aforementioned problems and shortcomings of the prior art that the present invention is directed. However, in view of the sight systems in existence at the time of the present invention, it was not obvious to those persons of ordinary skill in the pertinent art as to how the identified needs could be fulfilled in an advantageous manner.

SUMMARY OF THE INVENTION

The present invention provides a modular sight system for guns having a unique universal back plate receptacle and interchangeable sight components which enhance the speed and accuracy of target acquisition, sight and aiming functions, hand-eye coordination, and provides for quick change of sight devices for different functions and purposes. This relates primarily to an improved optical sighting system for guns with a vertically oriented "runway" with multiple inserts that provides inherent alignment, but also can accommodate additional accessories. The rear back plate of the gun slide as manufactured is replaced with the instant back plate and interchangeable components for a variety of objectives, training techniques, and superior shooter/shooting skills.

The modular system utilizes the inventive back plate receptacle having a mounting base which dimensioned fit within the area of the gun where the original back plate is removed, and also has an attachment receptor in which interchangeable sight components are inserted, many of which include various "runway" sights. The runway sections themselves are generally vertical rectangular members of various depths which immediately capture the shooter's eye and direct the optical sighting while providing three (3) points of reference: the gun front sight, gun rear sight, and runway sight of the back plate receptacle.

In some embodiments, the runway sight is adjustable to further enhance optical recognition and create a "lollipop" sight. In other embodiments, runway member including a generally T-shaped top section which complements the rear sight of many gun manufactures, and also allows, as an option, the inclusion of laser sights and other accessories.

The modular sight system also includes color reveals in the attachment receptor and runway sight member which provide correct optical and sight alignment with gun and target. If the gun is held or aimed incorrectly, alternative contrasting colors (other than the color of the back of vertical sight member) are instantly seen by the shooter, indicating errors in the handling and/or aim with respect to the weapon and target.

The modular sight system and components are new and improved optical sights and visual focal points. They are extremely lightweight, require minimal assembly for installation without special tools, can be retro-fit or constitute an original OEM system, and provide a variety of interchangeable attachments for different functions and objectives.

Accordingly, it is an object of the present invention to provide more efficient, improved designs for gun sight systems, which enhance speed and accuracy in gun alignment, target acquisition, aim and shooting.

It is another object of the present invention to provide a modular gun sight system which is compatible with, and can replace, the slide back plate of the original manufacturer, and which provides a superior sight system.

It is another object of the present invention to provide a modular gun sight system having interchangeable sight components, and incorporates a three (3) point alignment for sight and target acquisition.

It is another object of the present invention to provide a modular gun sight system which incorporates various vertical runway members for enhanced visual-motor coordination, flexible and accurate eye focusing control.

It is yet another object of the present invention to provide a modular gun sight system which is cost effective and operationally efficient.

Finally, is an object of the present invention to a modular gun sight system which incorporates all of the above mentioned functions, objects and features.

In accordance with these and other objects which will become apparent hereinafter, the instant invention will now be described with particular reference to the accompanying drawings.

DETAILED DESCRIPTION

The inventive subject matter of the instant modular sight system relates generally to fixed and adjustable back plate receptacles for striker fired double action or single action semi-automatic style pistols, and modern-day rifles which incorporate interchangeable fixed and adjustable device attachments and inserts. The system is adaptable, and can be modified for alternative gun styles and designs. The fixed and adjustable back plate receptacles are a new and improved means for adding and mounting new and conventional interfitting gun components, device attachments and inserts; all improving optical sights, sight-to-target acquisition, user eye, hand, and gun coordination, and accuracy.

The novel designs described herein also have utility with respect to non-lethal guns such as those firing rubber bullets, stun guns, simulation guns, and bean-bag guns used by law enforcement officers and the military, as well as airsoft and paintball pistols and rifles. Applications further include sporting goods and children's toys.

Figure 1:
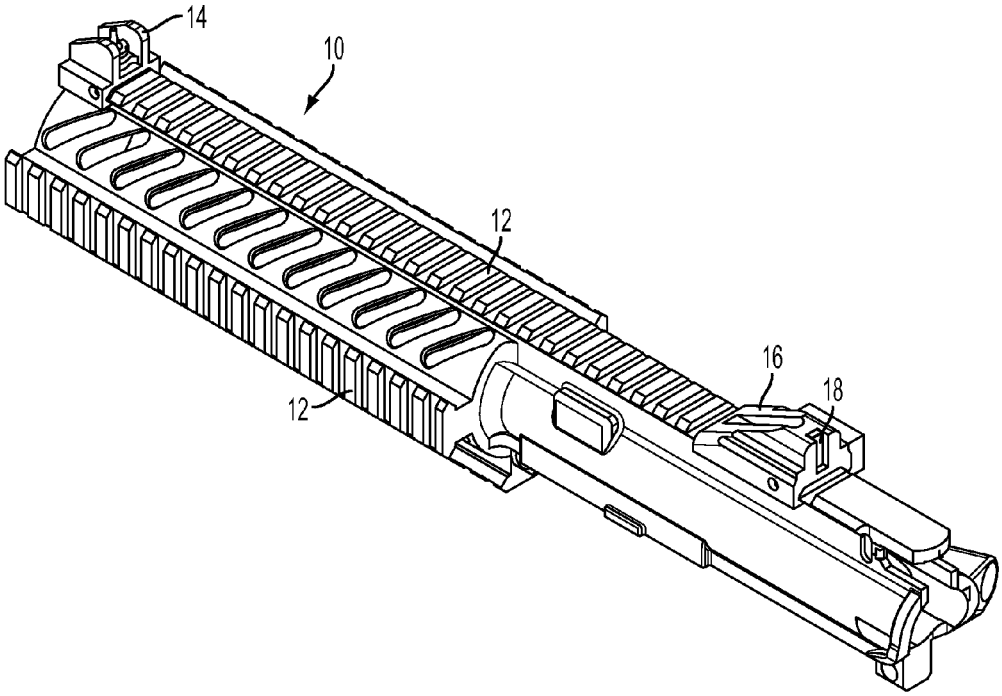
FIG. 1 is a side perspective view of one embodiment of the present invention illustrating the modular rear sight system for rifles.
Figure 2:
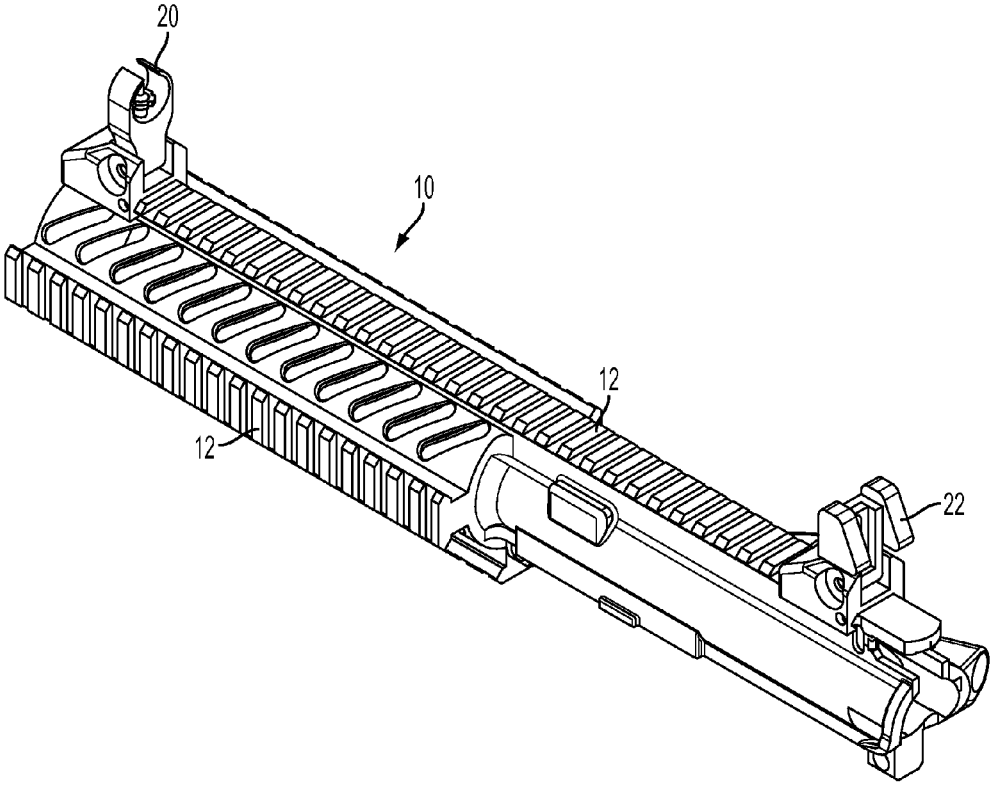
FIG. 2 is an alternative side perspective view of one embodiment of the present invention illustrating the modular rear sight system for rifles having retractable components.
Figure 3:
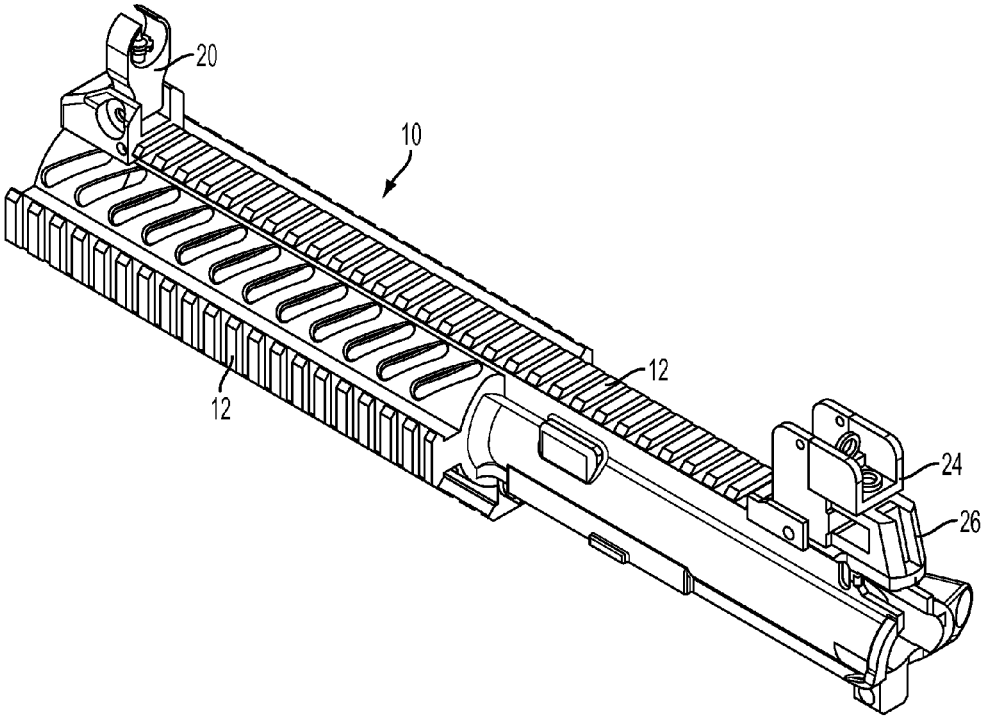
FIG. 3 is an alternative side perspective view of one embodiment of the present invention illustrating the modular rear sight system for rifles having adjustable components.

With respect to FIG. 1 through FIG. 3, the modular sight system with embedded runways are illustrated with respect to use with certain modern rifles 10. FIG. 1 is a front perspective view of one embodiment of the present invention, which depicts a sporting rifle with picatinny rails 12, front sight 14 and rear runway sight member 16, which includes a vertical, generally rectangular sight component 18. The runway sight member 16 is removable, and this figure depicts a compact or micro version which is utilized by shooters who prefer a sighting system which is closer to the bore axis or barrel for improved close to medium range shooting.

FIG. 2 is another perspective view of one embodiment of the present invention, which is a flip-up version of the embedded runway including front sight 20 and rear runway sight member 22. The flip-up version is used as backup sites for shooters who wish to attach a scope, reflex sight, or optic member that aids in target acquisition. The flip-up rear sight member 22 rotates from a generally horizontal position to a generally vertical position and locks in and upright position when deployed. In the retracted position, rear sight member 22 folds to be flush with the rifle or picatinny rails 12.

FIG. 3 is an alternative perspective view of another embodiment of the present invention, which illustrates a fully adjustable version of the modular rear sight system with embedded runway components for rifles. This adjustable version is preferred by shooters who engage long-range targets while making unencumbered use of the fixed sights with windage and elevation adjustability. Vertical sight member 26 is set within the rear sight module in an embedded channel, inverted or concave design. The sides of the runway embedded channel can include contrasting colors, or color reveals, which aid in target acquisition, site-to-target alignment, and provide a visual indicator of incorrect aim or gun position. When the gun is held correctly with respect to the target, the contrasting sides of vertical sight member 26 are not visible, as only the color and shape of the vertical base of the generally vertical channel member is apparent; when the gun is incorrectly positioned with respect to the sight system and target (off aim), the contrasting colors of the sides of the vertical sight member are apparent as a clear visual indication to the shooter. As one example, the color of the vertical base of sight member 26 can be bright white, with the contrasting sides of sight member 26 being bright red, providing a stark visual indicator means.

The colors of the sides of the runway member become visible when the gun is held incorrectly at an angle to the users horizontal viewpoint. The runway member and its contrasting colors are used to establish several different optical alignments, aiming, and visual contact advantages. The runway and its incorporation of different color sections can be visually centered in the field of view for aiding users and aiming their line of sights from the vertical sight member to the target or from the target to their line of sights.

Figure 4:
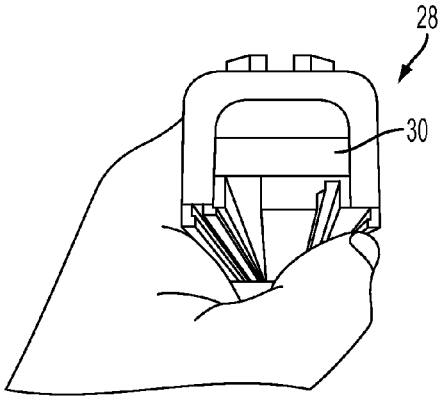
FIG. 4 PRIOR ART
FIG. 4 is a rear perspective view depicting the OEM slide back plate of a conventional semi-automatic pistol.
Figure 5:
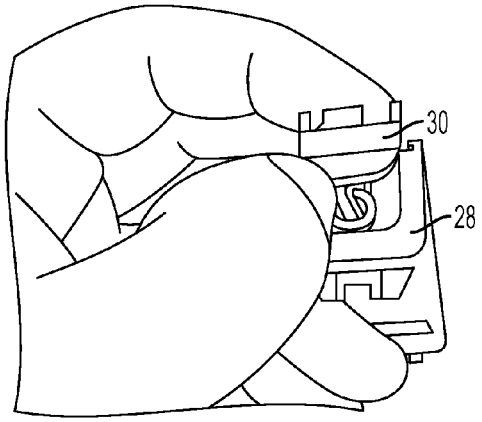
FIG. 5 PRIOR ART
FIG. 5 is a rear perspective view depicting the OEM slide back plate of a conventional semi-automatic pistol illustrating the back plate partially removed.
Figure 6:
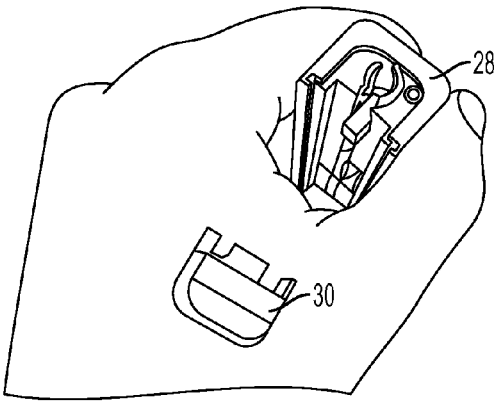
FIG. 6 PRIOR ART
FIG. 6 is a rear perspective view depicting the OEM slide back plate of a conventional semi-automatic pistol illustrating the back plate fully removed.

With reference to FIG. 4, this depicts a rear perspective view of conventional pistol gun slide 28 removed from the gun, and having a conventional back plate 30. The back plate 30 of a striker fire semi-automatic pistol is the flat cover plate on the back of the slide. The Back Plate Receptacle of the instant invention (described hereinafter) fits into grooves of the slide 28 and is held into place by spring tension. The cover plate must be removed to gain access to the firing pin and extractor components. FIG. 5 shows the partial removal of the conventional or OEM back plate 30, from pistol slide 28, and FIG. 6 shows the back plate fully removed, with access to the gun firing pin and extractor components.

The back plate receptacle component of the inventive modular rear sight system replaces the original slide cover plate of the gun. The improved receptacle enables the gun handler to utilize the back plate area for multiple purposes without the need for specialty tools, manufacture or gunsmith services. The receptacle can be used for fixed or adjustable attachments, many described hereinafter.

Figure 7:
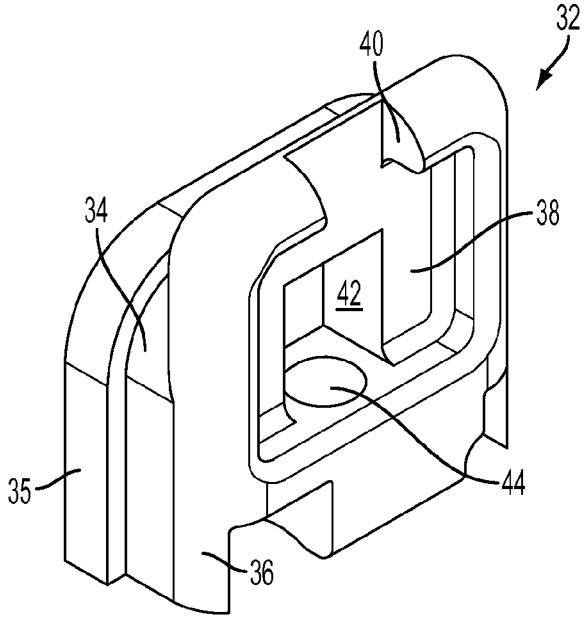
FIG. 7 is a rear perspective view of one embodiment of the present invention illustrating the novel back plate receptacle.

FIG. 7 is a rear perspective view of one embodiment of the design of the novel universal back plate receptacle 32 removed from the gun. Here, back plate receptacle 32 is a fixed design, for non-adjustable attachments and inserts. The receptacle is generally comprised of a mounting base 34, and attachment receptor 36 which defines an attachment fastening area. Mounting base 34 provides for fitted engagement with the slide rear back plate section, and clips into the slide in the same manner as the original manufacture's slide cover plate. The mounting base 34 can be adapted to support multiple gun brands. In this embodiment, mounting base 34 has a protruding flange 35 around its periphery, providing for fitted engagement with grooves in the slide's rear back plate section for receiving a cover plate.

The attachment receptor 36 includes a central recess 38 and alignment slot 40 for receiving and securing interchangeable attachments with sight components.

Alternatively, central recess 38 can include cavity 42, which receives and accommodates a component of a sight insert, as well as a bore 44 for hardware to further secure the insert.

The attachment receptor's fastening area can be of a generally square shaped block with bullnose edges, having a two point attachment design. The first attachment exists by way of a fitted insertion point. The attachment fastening area contains one or more slots that align to the shape and size of the inserts. A second attachment exists by way of hardware, or a screw-like mechanism that is inserted from the bottom of the base plate receptacle through a bore/cylindrical pathway and into the insert within the attachment receptor. The combination of the slots and optional hardware secure the inserts both vertically and horizontally.

Figure 8:
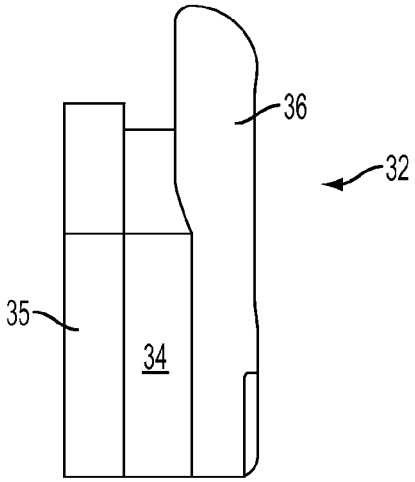
FIG. 8 is a side view of one embodiment of the present invention illustrated in FIG. 7.

FIG. 8 is a side view of the device shown in FIG. 7, with back plate receptacle 32, mounting base 34, and attachment receptor 36.

Figure 9:
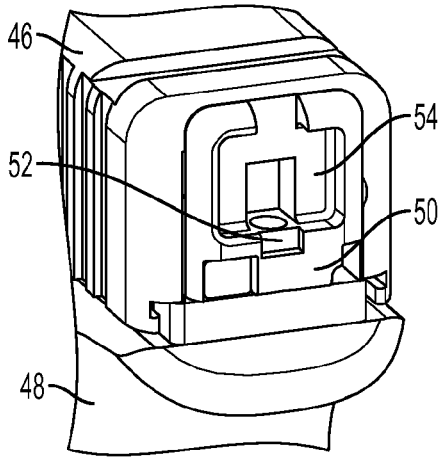
FIG. 9 is a partial rear perspective view of one embodiment of the present invention illustrating the novel back plate receptacle installed in a gun slide.

Turning to FIG. 9, a partial rear perspective view is shown, of an embodiment of the novel adjustable back plate receptacle installed in a gun slide 46 attached to the gun 48. The adjustable back plate receptacle 50 has an additional groove or lower recessed channel 52 within central recess 54 for receiving and accommodating a component of an adjustable sight attachment. Lower recessed channel 52 is designed to retain the inserts in place while being adjusted. The inserts described below have a protruding base flange or extended vertical portion that also conceal a hardware mechanism that sits within the central recess cavity area. The hardware can be screw-like and positioned within the bottom of the receptacle through the cavity area, and is adjustable to provide vertical movement of an insert for sight adjustment, and also to further secure the insert within the attachment receptor.

The back plate receptacle has the ability to function with many different gun parts and devices. For example, laser light sights, flashlights, logo plates, clip holsters, charging handles, picatinny rails, and a variety other conventional gun components. Due to the inherent nature of the modular sight system, component designs, and attachment fastening means, all parts and devices can easily be designed to adhere to the insert specifications. This enables gun users to attach devices without specialized tools or modifications to the guns. The following describes several of the inter-fitting gun parts, device inserts, and interchangeable attachments. These examples provide new and improved optical sight and visual focal devices, as well as inserts that are fixed and adjustable.

Figure 10:
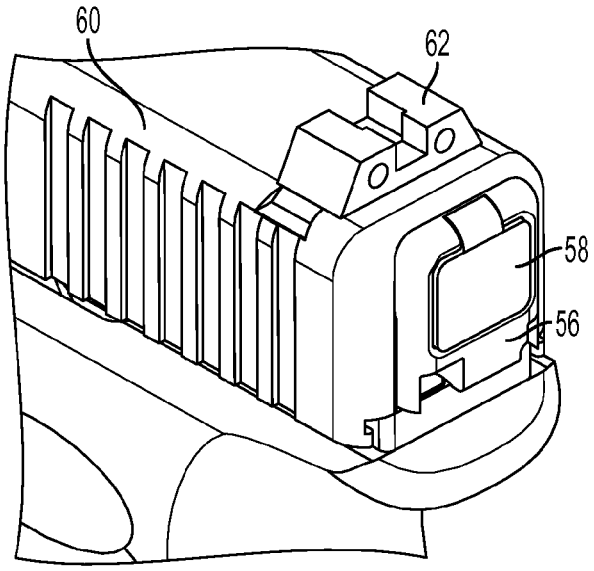
FIG. 10 is a partial rear perspective view of one embodiment of the present invention illustrating the novel back plate receptacle with an interchangeable insert, installed in a gun slide.
Figure 11:
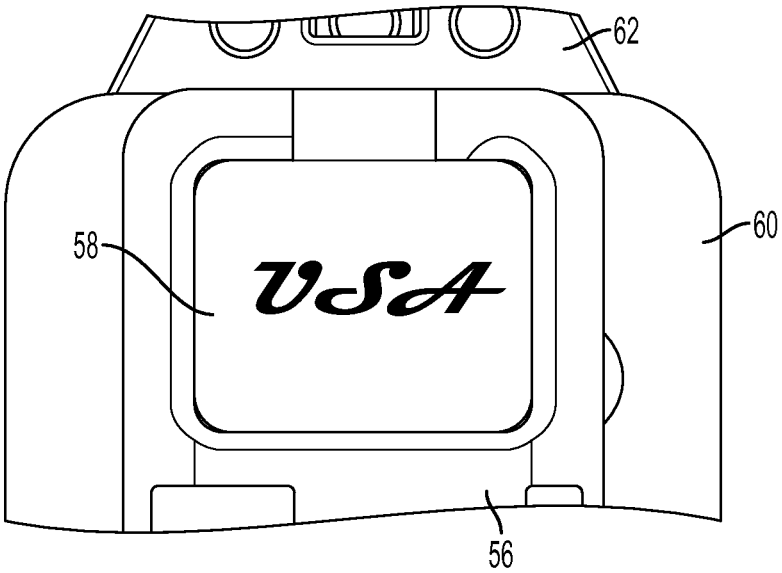
FIG. 11 is a rear partial view of one embodiment of the present invention illustrating the novel back plate receptacle with a graphical insert, installed in a gun slide.

FIG. 10 is a partial rear perspective view of one embodiment of the novel back plate receptacle 56 with an interchangeable insert 58, installed in a gun slide 60 having a rear sight 62. Here, insert 58 is adaptable to be a blank rear cover, or alternatively one which can accommodate graphics, such as printed or embossed lettering, words, titles, logos, pictures or any graphic art. FIG. 11 is a review view of the apparatus shown in FIG. 10, with an example of stylized lettering thereon.

Figure 12:
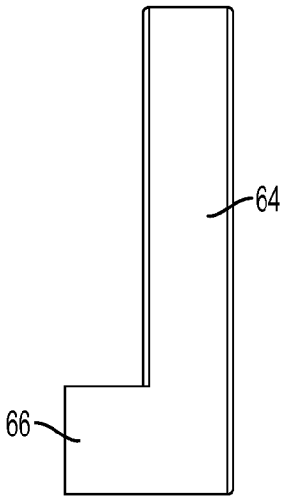
FIG. 12 is a side view of one embodiment of the present invention illustrating a standard runway sight member.

Referring now to FIG. 12, a non-adjustable standard runway insert is illustrated. By non-adjustable, it is meant that the insert in this embodiment is not vertically adjustable. Vertical sight member 64 is generally rectangular, and is secured within the central recess and slot alignment of attachment receptacle 36 as described above. Vertical sight member can also include a protruding base 66 for insertion into the central recess cavity 42 as shown in FIG. 7.

Figure 13:
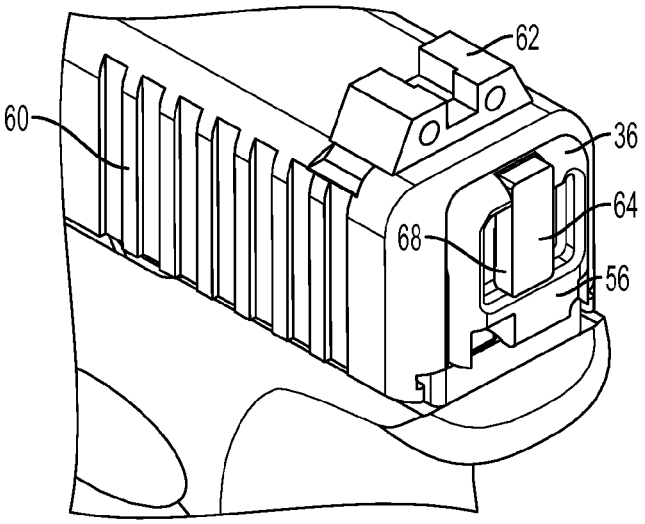
FIG. 13 is a partial rear perspective view of one embodiment of the present invention illustrating the novel back plate receptacle with a standard runway sight member insert, installed in a gun slide.

FIG. 13 depicts vertical sight member 64 inserted within the modular back plate receptacle 56 and attachment receptor 36. In this design, the runway sight is generally flush or co-planar with the attachment receptor 36 and terminates at its upper edge. It can be seen that the runway sight, vertical sight member 64, is positioned such that it is generally centered in the attachment receptor 36 and is aligned with rear gun sight 62, substantially aiding shooters with their line of sight from the vertical sight member, gun sight and target, or the reverse sequence.

As noted heretofore, the modular sight system also includes color reveals in the attachment receptor with the runway sight member, enhancing aim and correct optical and sight alignment with gun and target. If the gun is held or aimed incorrectly, alternative colors (other than the color of the back of the vertical sight member) are instantly seen by the shooter, indicating errors in the handling and/or aim with respect to the weapon and target. Sides 68 of vertical sight member 64 can be of sharply contrasting colors from that of the back surface of the sight member, such as bright red or green versus bright white, which is instantly visually processed by the shooter and enables corrective actions. Errors in aim can be caused by incorrect field of view, angularly, vertically and/or horizontally. With correct aim and alignment the side colors of the runway sight are not visible.

Figure 14:
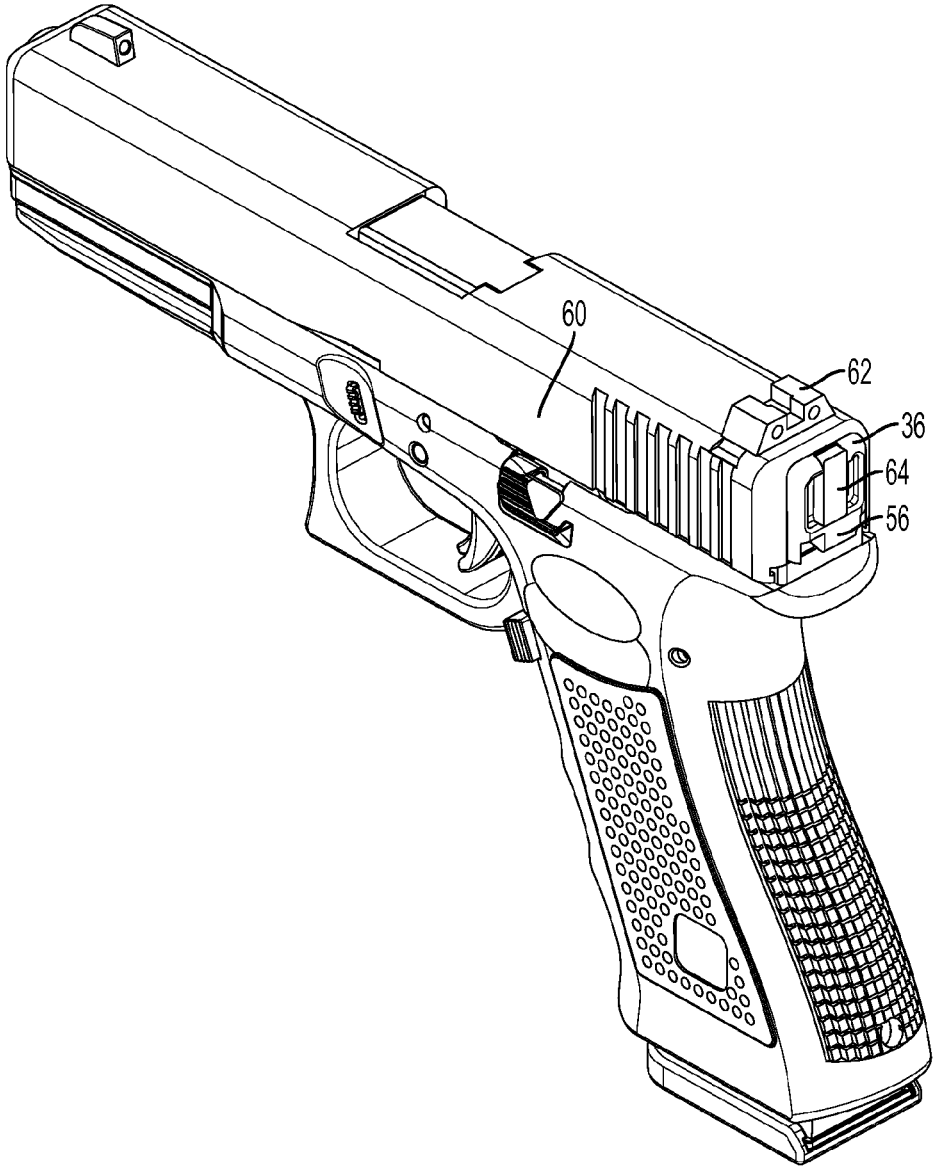
FIG. 14 is a complete perspective view of one embodiment of the present invention illustrating the novel back plate receptacle with a standard runway sight member insert, installed in a gun slide of a pistol.

FIG. 14 is a complete side perspective of a pistol incorporating the modular rear sight system, back plate receptacle, attachment receptor and runway sight member as described with respect to FIG. 13.

Figure 15:
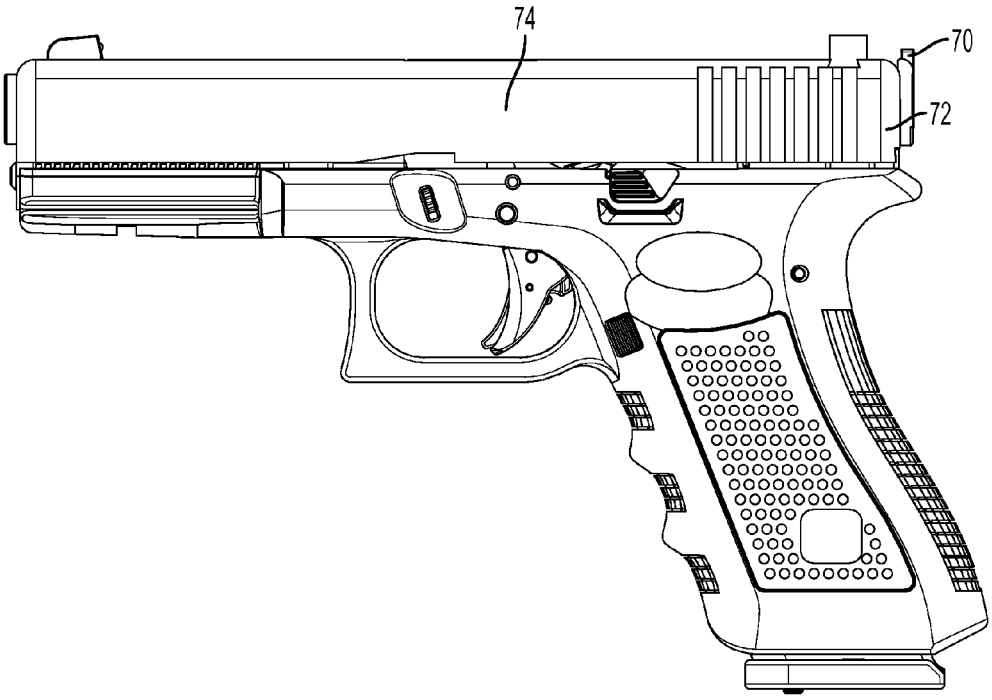
FIG. 15 is a complete side view of one embodiment of the present invention illustrating the novel back plate receptacle with an extended runway sight member insert, installed in a gun slide of a pistol.
Figure 16:
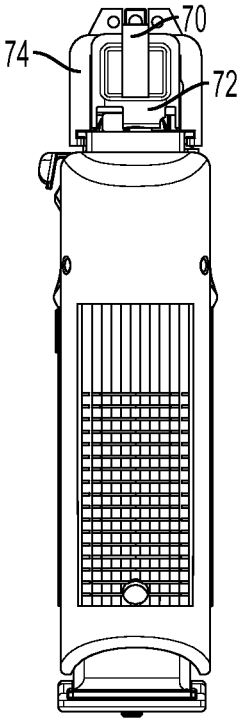
FIG. 16 is a rear view of the embodiment illustrated in FIG. 15.

Referring to FIG. 15 and FIG. 16, an extended runway or vertical sight member 70 is illustrated as inserted within back plate receptacle 72 that is secured to the rear of slide 74 of a pistol. FIG. 15 represents a complete side view, and FIG. 16 is a rear view thereof.

Figure 17:
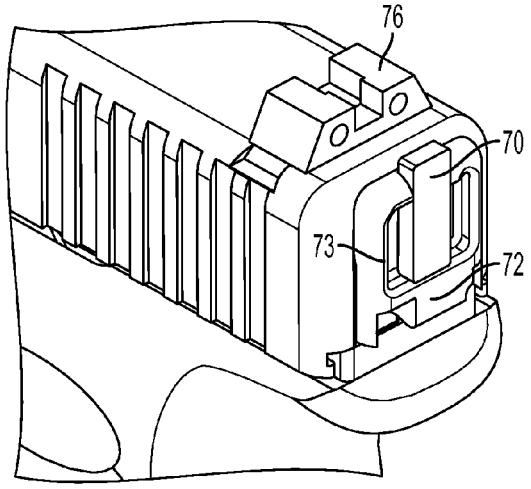
FIG. 17 is a partial rear perspective view of one embodiment of the present invention illustrating the novel back plate receptacle with an extended runway sight member insert, installed in a gun slide.

The extended runway is dimensioned to extend above the upper edge of attachment receptor 73 of back plate receptacle 72, as seen in FIG. 17, and provides a further complementary alignment with rear gun sight 76. In this version, the extended runway provides an additional optical sight aid, also referred to a lollipop sight, assisting in aligning gun to target.

Figure 18:
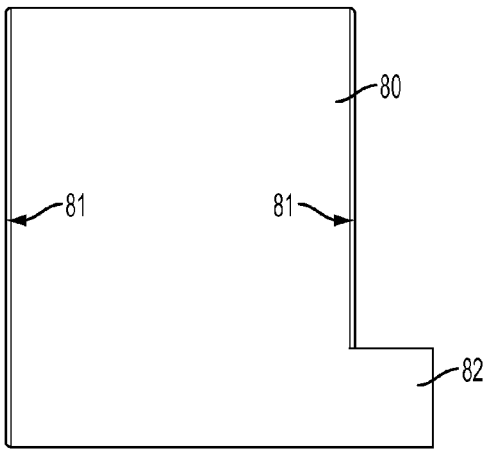
FIG. 18 is a side view of one embodiment of the present invention illustrating a training runway sight member.
Figure 19:
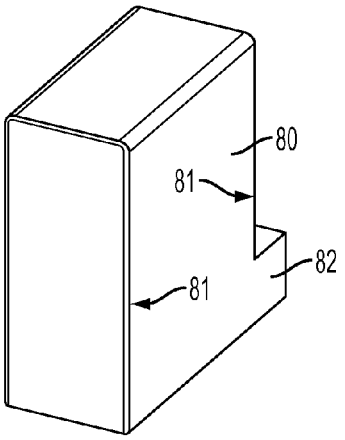
FIG. 19 is a perspective view of the embodiment illustrated in FIG. 18.
Figure 21:
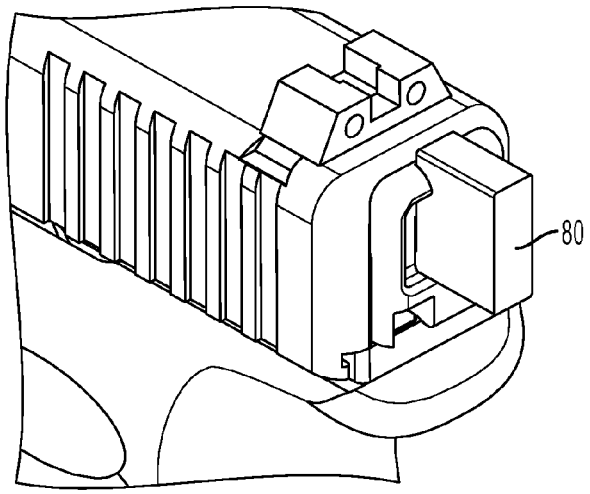
FIG. 21 is a partial rear perspective view of one embodiment of the present invention illustrating the novel back plate receptacle with an alternative training runway sight member insert, installed in a gun slide.

FIGS. 18, 19 & 21 depict a side view, perspective view, and partial perspective view of a training runway or training vertical sight member 80. This runway can be used for training purposes, and has increased depth 81 and conspicuous features of the sight member further enhancing visual recognition for the shooter. Protruding base member 82 provides for insertion into the central recess of the attachment receptor.

Figure 20:
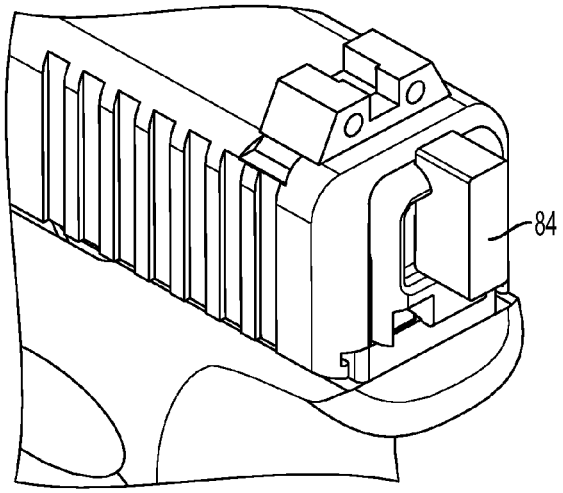
FIG. 20 is a partial rear perspective view of one embodiment of the present invention illustrating the novel back plate receptacle with an intermediate runway sight member insert, installed in a gun slide.

FIG. 20 shows an intermediate vertical sight member 84 secured within back plate receptacle and attachment receptor positioned on a gun slide and aligned with the gun rear target, similar to the view presented in FIG. 17.

Alternative designs for the runway sight member include even greater increase in depth for use by those with little or no experience in handling guns. FIG. 21 illustrates a partial perspective view of an interchangeable vertical sight member 80 inserted within the back plate receptacle of the instant invention, in a view corresponding to that of FIG. 20, and the increased depth is readily apparent. As with all the attachment receptors and runway sights, color reveals can be incorporated to further aid optical recognition.

With the intermediate and beginner runway sights, the vertical sight members 80 & 84 respectively have increased depth, and are dimensioned to extend outwardly from the attachment receptor which provides for extreme points of reference and additional optical recognition.

Figure 22:
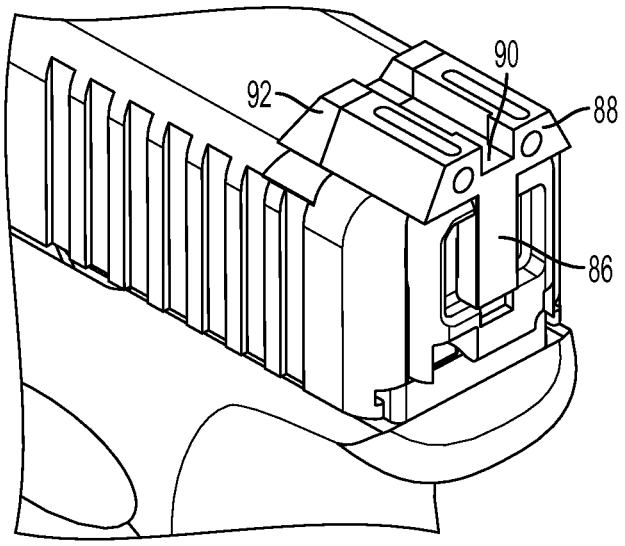
FIG. 22 is a partial rear perspective view of one embodiment of the present invention illustrating the novel back plate receptacle with an alternative integrated runway sight member insert with an elongated section, installed in a gun slide.

FIG. 22 is a partial rear perspective view illustrating the novel back plate receptacle with an alternative integrated runway sight insert with an elongated section, installed in a gun slide. In this embodiment, integrated vertical sight member 86 includes a generally horizontal T-shaped top section 88, which extends above the attachment receptor and over the gun slide to the rear gun sight, and also defines a channel 90. Channel 90 is horizontally and vertically aligned with secondary replacement rear gun sight 92, giving the vertical sight member a goal post shaped appearance. The T-shaped top section is complementary to the rear replacement gun sight 92 in shape and dimensions, and fits flush therewith. The replacement rear gun sight 92 in positioned on the gun slide once the OEM rear gun sight is removed. This integrated, elongated runway sight provides a natural visual path from the back of the gun to the rear gun sight, front sight and target.

Figure 23:
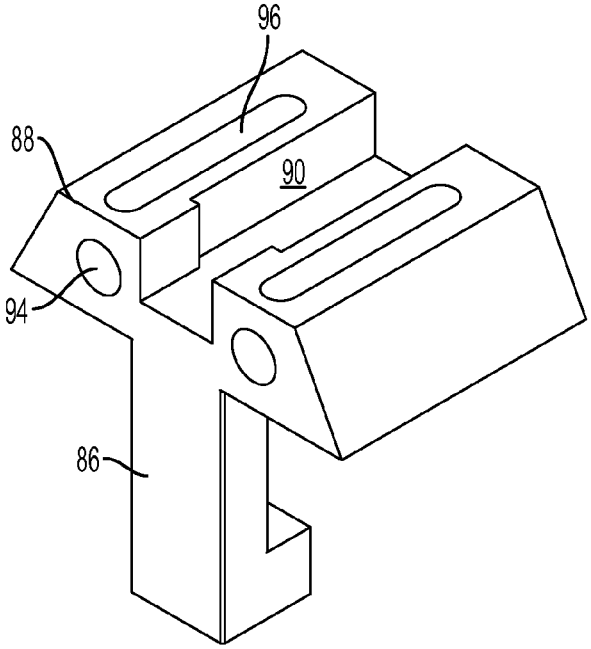
FIG. 23 is a perspective view of the integrated runway sight member illustrated in FIG. 22.

FIG. 23 is a perspective view of the integrated, elongated vertical sight member 86, with the T shaped top section 88. The T top section can incorporate optical sight aids 94 and 96, such as light means, fiber optics, night sight tritium inserts or the like.

Figure 24:
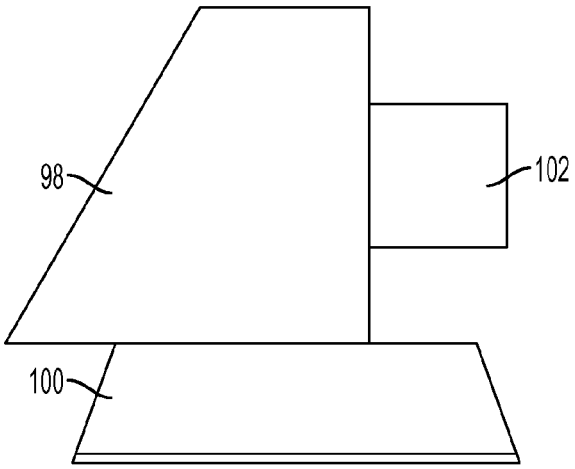
FIG. 24 is a side view a replacement rear sight for an OEM rear sight, to provide a flush engagement with the integrated runway sight member illustrated in FIG. 23.

FIG. 24 is a side view a replacement rear sight 98 for an OEM rear sight, which provides a flush engagement with the integrated runway sight member 88 illustrated in FIG. 23 and FIG. 24. The replacement rear gun sight includes a base 100 and alignment are 102 to interface with both the gun slide and the integrated runway sight.

Figure 25:
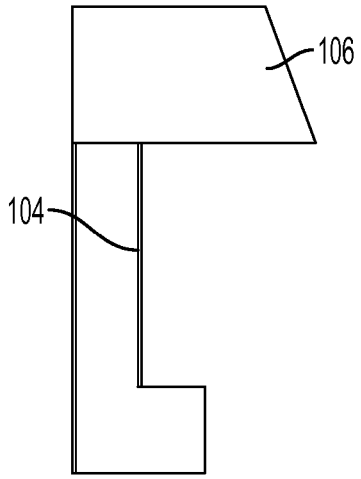
FIG. 25 is a side view of one embodiment of the present invention illustrating an alternative integrated runway sight member.

FIG. 25 is a side view of an alternative integrated runway sight member. Integrated vertical sight member 104 includes a generally T shaped top section 106, which not as extended or of the same depth as that shown in FIG. 23. This insert is utilizes with the original manufacture's rear gun sight, and does not include a secondary replacement sight for the gun.

Figure 26:
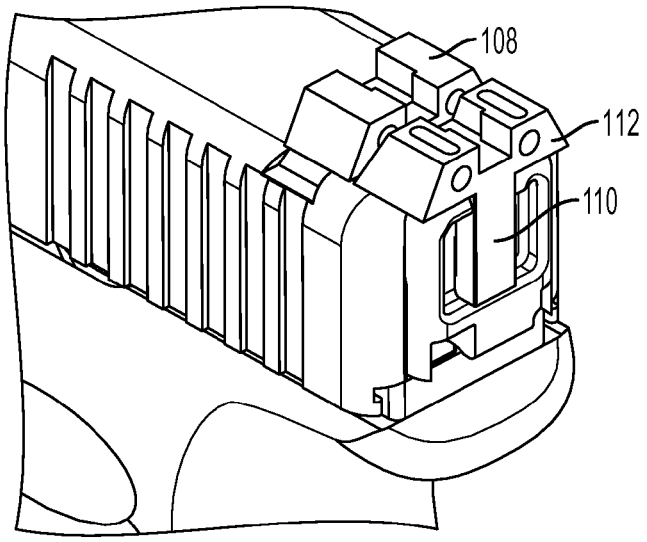
FIG. 26 is a partial rear perspective view of one embodiment of the present invention illustrating the novel back plate receptacle with the integrated runway sight member shown in FIG. 25, installed in a gun slide.

FIG. 26 is a partial rear perspective view illustrating the novel back plate receptacle with the integrated runway sight member 110, installed on a gun slide. The T shaped top section 112 extends rewardly toward the OEM rear gun sight in a complementary fashion, but is not flush therewith.

Figure 27:
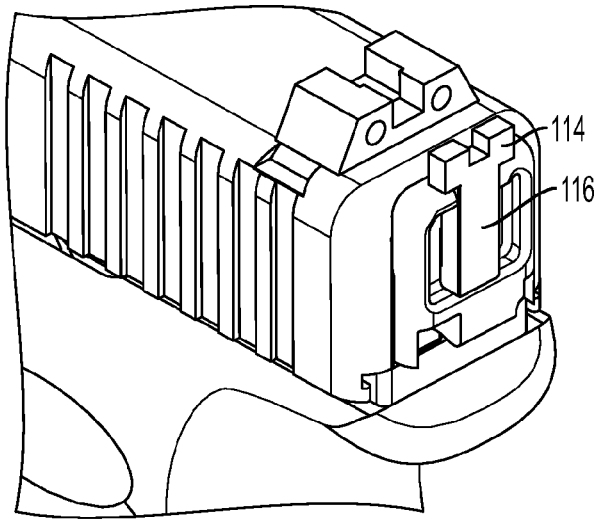
FIG. 27 is a partial rear perspective view of one embodiment of the present invention illustrating the novel back plate receptacle with the alternative top section for an integrated runway sight member, installed in a gun slide.

FIG. 27 is a partial rear perspective view illustrating the improved back plate receptacle with an alternative geometric shape for top section 114 of integrated runway sight member 116, installed on a gun slide.

Figure 28:
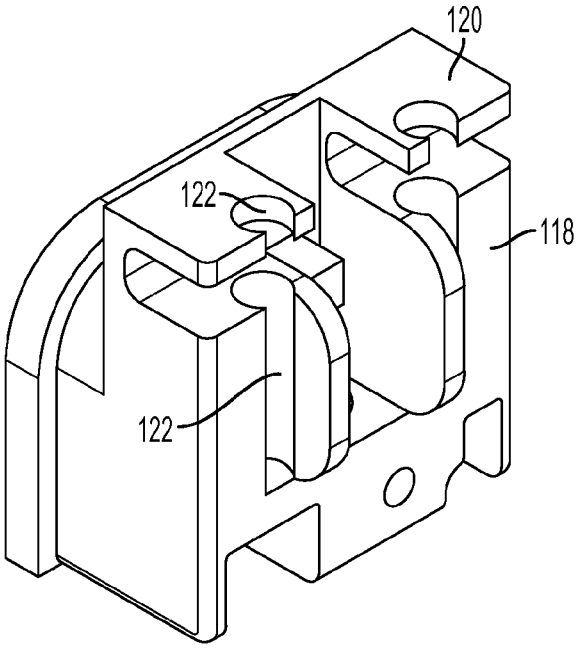
FIG. 28 is a rear perspective view of one embodiment of the present invention illustrating the novel back plate receptacle incorporating a receptor for fiber optics and light means inserts.

FIG. 28 is a rear perspective view showing an alternative back plate receptacle 118 incorporating an attachment receptor 120 for receiving accessories such as fiber optics and light means inserts. Receptor 120 defines voids and channels 122 to accommodate inter-fitting accessories by snap fit or otherwise to be secured within.

Figure 29:
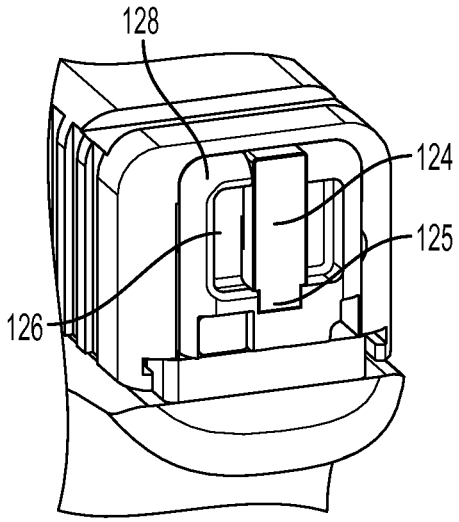
FIG. 29 is a partial rear perspective view of one embodiment of the present invention illustrating the novel back plate receptacle with an adjustable runway sight member insert, installed in a gun slide.

FIG. 29 is a partial rear perspective view which depicts back plate receptacle, and attachment receptor 128 with an adjustable vertical sight member attachment/insert 124 attached therein, and installed in a gun slide. Adjustable sight attachment 124 includes a protruding base flange 125 for fitted engagement with the lower recessed channel of the attachment receptor's central recess 126. The fit, alignment and adjustment features include those described with reference to the attachment receptor of FIG. 9. When adjusted for raised elevation in the upright position, this runway sight provides for additional optional control by a shooter.

Figure 30:
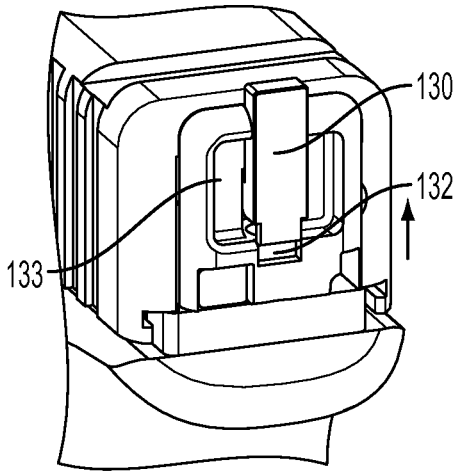
FIG. 30 is a partial rear perspective view of the embodiment shown in FIG. 29 with the adjustable runway sight member insert in the extended position.

FIG. 30 is a partial rear perspective view of the device shown in FIG. 29 with the adjustable runway sight member insert 130 in the extended upright position, and exposing the lower recessed channel 132 of central recess 133.

Figure 31:
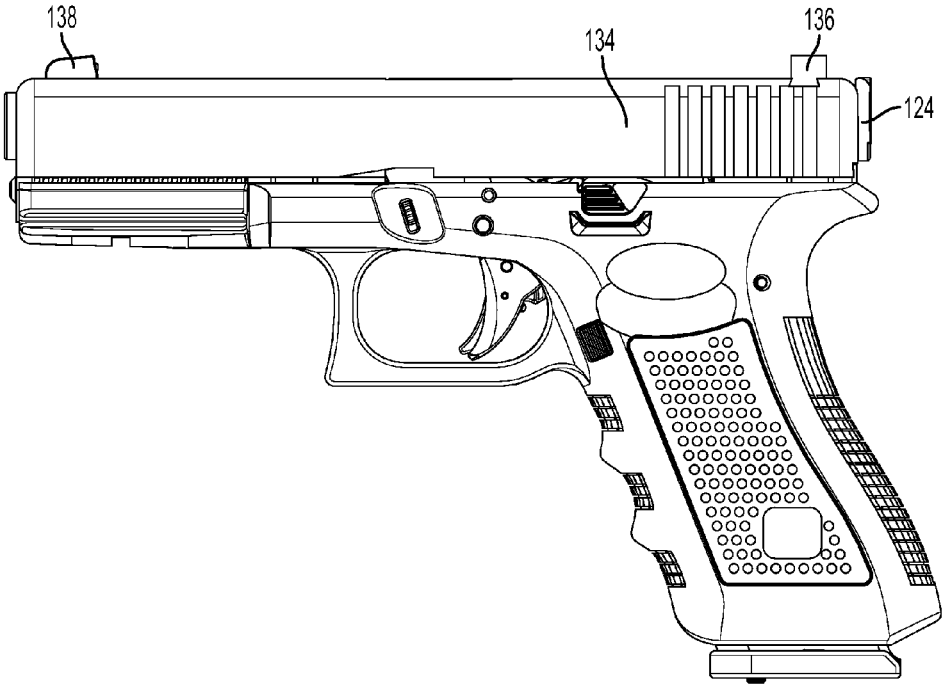
FIG. 31 is a complete side view the embodiment of the present invention shown in FIG. 30, installed in a gun slide of a pistol.

FIG. 31 is a complete side view of the sight device shown in FIG. 30, installed in a gun slide of a pistol. Adjustable vertical sight member 124 is shown in a partially raised position, along with gun slide 134, rear gun sight 136 and front sight 138.

Figure 32:
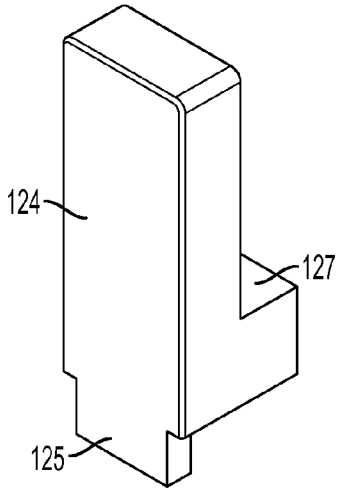
FIG. 32 is a perspective view of the adjustable runway sight member shown in FIG. 29.
Figure 33:
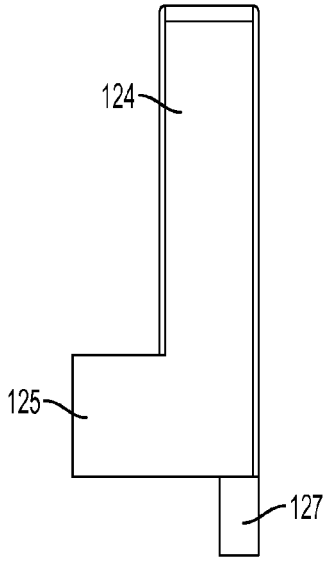
FIG. 33 is a side view of the embodiment shown in FIG. 32.

FIG. 32 is a perspective view of the adjustable runway sight member shown in FIG. 29, including adjustable vertical sight attachment 124, protruding base flange 125 and protruding base 127. FIG. 33 is a side view of the device shown in FIG. 32.

Figure 34:
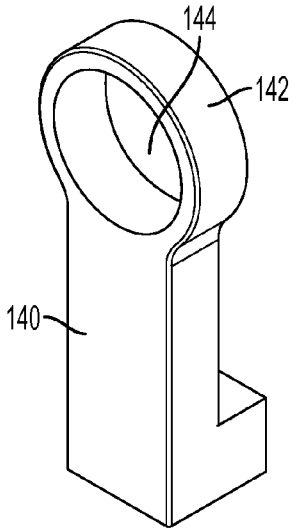
FIG. 34 is perspective view of one embodiment of the present invention illustrating an integrated runway sight member having upper generally circular sight component.

With reference to FIG. 34, this depicts an integrated runway sight member 140 having an upper generally circular sight 142 as a component thereof. The circular sight can comprise a ring with a central void 144 for alignment with the front sight of a gun.

Figure 35:
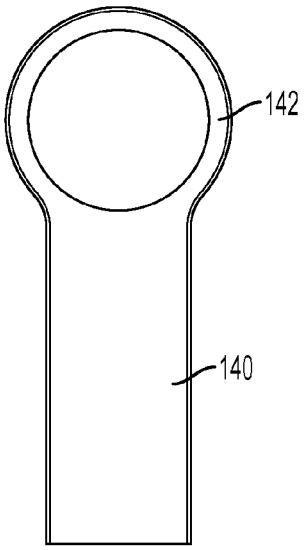
FIG. 35 is front view of the embodiment illustrated in FIG. 34.

FIG. 35 is front view of the embodiment illustrated in FIG. 34.

Figure 36:
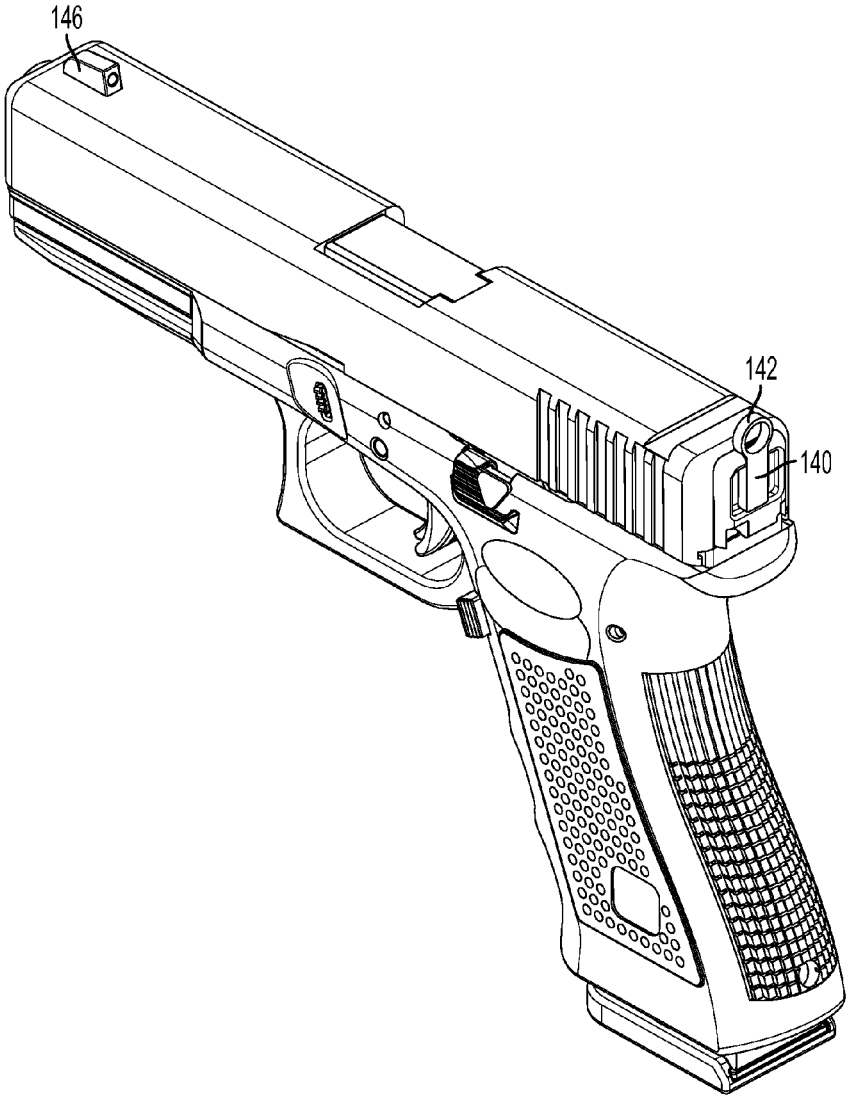
FIG. 36 is a side perspective view of the embodiment of the present invention shown in FIG. 35, installed in a gun slide of a pistol.

FIG. 36 is a side perspective view of the integrated circular top vertical sight member 140 shown in FIGS. 34 & 35, secured within the attachment receptor and installed in the gun slide of a pistol. This creates a "ghost ring" visual effect for aim and the O ring aligns with the front gun sight, also having the lollipop effect described above, and providing an additional, alternative point of reference with respect to other sight devices shown and described above.

Figure 37:
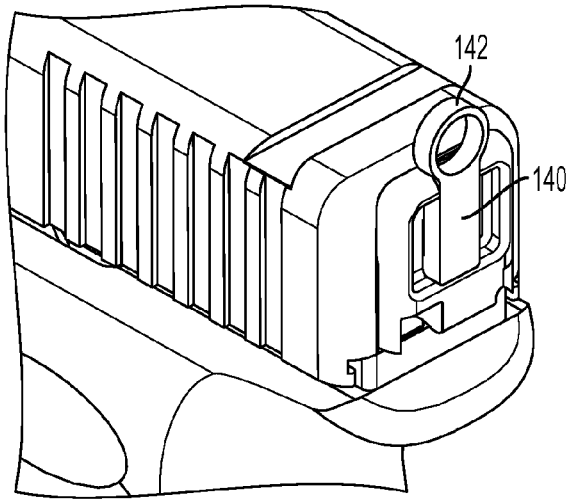
FIG. 37 is a partial rear enhanced perspective view of the embodiment shown is FIG. 36.
Figure 38:
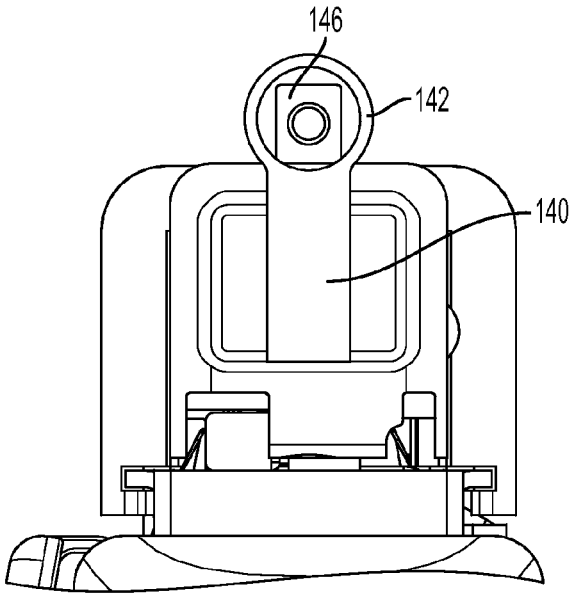
FIG. 38 is rear view of the embodiment shown in FIG. 37.

FIG. 37 is a partial rear enhanced perspective view of the structure shown is FIG. 36, and FIG. 38 is rear view of thereof.

The following figures represent alternative designs for integrated, single piece back plate receptacles which incorporate "runway" sight features of differing shapes and sections.

Figure 39:
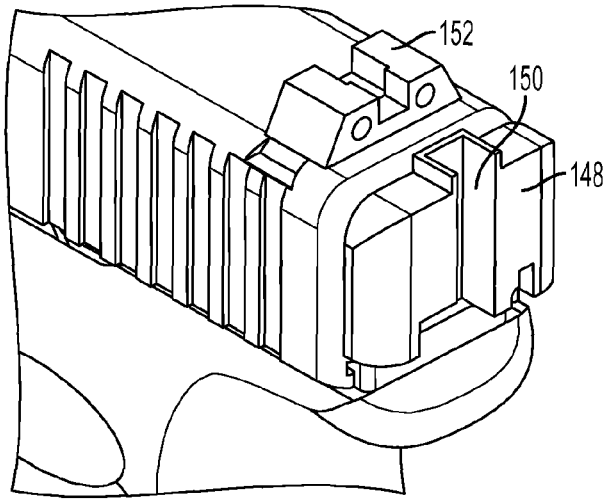
FIG. 39 is a partial rear perspective view of an alternative embodiment of the present invention illustrating the novel back plate receptacle with an integrated runway sight member having a channel incorporated therein.

Turning to FIG. 39, a partial rear perspective view illustrates a back plate receptacle with an integrated vertical sight member 148 having a channel 150 incorporated therein. Channel 150 constitutes the runway element, and provides the visual compatibility with rear gun sight 152.

Figure 40:
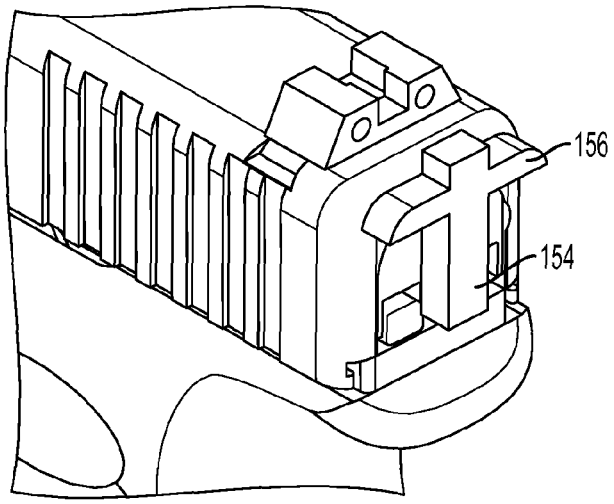
FIG. 40 is a partial rear perspective view of an alternative embodiment of the present invention illustrating an integrated runway sight member having an upper T shape member incorporated therein.
Figure 41:
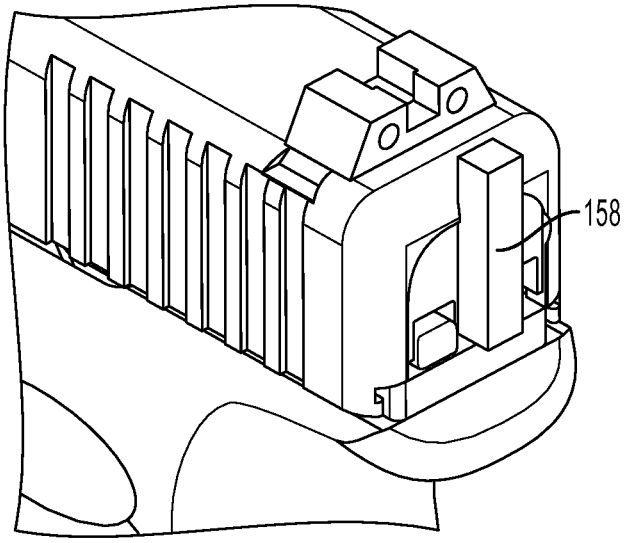
FIG. 41 is a partial rear perspective view of an alternative embodiment of the present invention illustrating an integrated runway sight member having a standard shape incorporated therein.

FIG. 40 is a partial rear perspective view of an alternative back plate receptacle with an integrated vertical sight member 154 having an upper T shape section 156 incorporated therein.

With reference to FIG. 4, a partial rear perspective view of another alternative back plate receptacle with an integrated runway sight member 158 having a standard shape incorporated therein.

It can be seen that the instant invention creates a variety of interchangeable gun sight components for striker fire gun mechanisms, and a quick change system for replacing the OEM slide rear back plate, with the improved back plate receptacle, mounting base and attachment receptor with inserts of the Inventor's designs. The modular rear sight system can be adjusted to the user's preference and particular positions on the novel back plate. The "runway" visual sight features and inserts provide for faster gun control, target acquisition and accuracy. The components provide for conspicuous visual display, optical and motor skills, and overall improvement in gun handling and shooting through repetition. A third point of references provided which increases the shooters visual ability for proper sight alignment and target acquisition. This sight system improves eye focusing flexibility and vision, allowing a quick adjustment of focus in different circumstances. Speed and flexibility in recognition time, change of target, and visual memory are enhanced through prolonged training and use of the modular rear sight gun system. Visual memory is utilized to embed learning elements of training to reach the point of automaticity. Reaching this point implies the speed of processing and performing a set of skills is fast, having a relative lack of effort to perform, and the skill is autonomous such that it may be initiated and run essentially without an active, voluntary conscious thought process. This is also useful in avoiding visual perceptual overload resulting in confusion and target recognition.

Medical professionals and those in the gun industry have established that shooting a pistol with speed and accuracy requires precise visual-motor (eye-hand-body) coordination, and flexible and accurate accommodation (eye focusing) control. Vision is a learned process that includes a variety of motor movement, perceptual and cognitive skills and abilities that develop throughout life and is instrumental in both target recognition and target acquisition. Among the most important visual skills and abilities necessary to maintain accurate eyesight while shooting are contrast sensitivity (the ability of the visual system to distinguish an object from its background), accommodation flexibility and precision, and exacting visual-motor coordination. Visual training techniques, including visual feedback and color feedback devices, can increase a shooter's ability and confidence in successfully striking a target. The instant inventions and alternative designs for a series of back plate receptacles and interchangeable devices improve a user's ability to shoot with more precision and accuracy, and represent an important advance in the art.

The runway sight elements described herein provide enhanced contrast adjacent to the rear sight of a pistol, thus allowing improved ability to rapidly and accurately accommodate (focus) on the rear sight. Studies have shown that improved contrast sensitivity, enhances both visual acuity (clarity of vision) and accommodation accuracy. The runway features provide a relatively large object of contrast to attract a user's visual attention and visual focus, allowing for a more precise ability to focus clearly and rapidly on the rear sight.

Another vision related advantage of the modular rear sight system with interchangeable components is to provide the shooter a directional gun positioning optical color feedback mechanism. By having contrasting colors that become visible only when the pistol is held incorrectly at an angle to the user's horizontal viewpoint, contrast sensitivity principles can be applied as a visual training feedback device. Shooters can learn to use color contrast information in guiding improved eye-hand-body (visual motor) control. As an expert behavioral optometrist once said; "Vision writes the spatial equations for muscles to solve." Arnold Sherman, O.D., FCOVD.

Any learned visual perceptual enhancement technique or visual stimuli improving visual recognition accuracy is useful to help control the Body Alarm Reaction by reducing visual stress. A device that further improves pistol front sight visual recognition and rapid rear sight focusing accuracy is the Ghost Ring vertical sight member as illustrated and described. This 'O' shaped device can be attached to a mounting device on the rear of a pistol, allowing additional directional 'line of sight' information. This added visual information allows for improved visual-motor integration, particularly improving spatial directionality eye-hand coordination.

Another benefit of all the versions of the sight inserts, those adjustable and integrated, concerns providing an additional visual feedback image related to central versus peripheral vision awareness and balance. It is important, particularly under combat stress, that a shooter's central vision not become fixated and constricted for an extended period of time (excessive tunnel vision response). Learning to encourage a shooter to be aware of visual images surrounding the sight components, particularly those outside of the O ring insert (maintaining ambient, peripheral vision) is crucial in maintaining a stable posture necessary for stable gun control. These devices act as a learning tools to train a user to be more sensitive to balancing central versus peripheral vision.

Visual training techniques and devices that improve visual abilities related to accuracy and speed of shooting a pistol are of paramount importance. The various devices described illustrated and claimed in the instant application allow a shooter to become competent in using a gun in an improved eye-hand-body coordinated and integrated manner. It also follows that improved accommodation control and accommodative flexibility will improve the speed of recognition of a visual image.

Fine-tuning the visual abilities of contrast sensitivity, optical color feedback, accommodation, and peripheral versus central vision balance and awareness, improves shooting accuracy and speed. The various embodiments of sight devices and designs as disclosed used by shooters with these visually guided principles will improve shooting accuracy and speed. Used with appropriate training and attention to visual detail, the modular rear sight system with interchangeable components and runway features will assist shooters 'hitting their target'.

Consequently, the instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A modular rear sight system and back plate receptacle for guns having a slide with a gun rear sight and rear back plate section for receiving a cover plate, comprising:

a back plate receptacle, said back plate receptacle having a mounting base and an attachment receptor;

said mounting base for fitted engagement with said slide rear back plate section;

said mounting base having a protruding flange about its periphery for fitted engagement within said grooves of said rear back plate section;

said attachment receptor for receiving interchangeable sight attachments;

said attachment receptor having a central recess and an alignment slot for receiving said interchangeable attachments in fitted engagement, said interchangeable attachments being inserted and secured therein;

interchangeable attachments for fitted engagement within said attachment receptor;

said interchangeable attachments comprising a generally rectangular vertical sight member, said vertical sight member being secured within said central recess and alignment slot; and said vertical sight member being complementary to said gun rear sight and aligned therewith.

2. The apparatus of claim 1, further comprising:

said vertical sight member including a protruding base; and said central recess including a cavity for receiving said vertical sight member protruding base.

3. The apparatus of claim 2, further comprising:

said central recess including a hardware bore for further securing said vertical sight member protruding base.

4. The apparatus of claim 1, further comprising:

said vertical sight member being dimensioned to be coplanar and generally flush with said attachment receptor.

5. The apparatus of claim 1, further comprising:

said vertical sight member being dimensioned to extend outwardly from said attachment receptor providing enhanced optical recognition.

6. The apparatus of claim 1, further comprising:

said vertical sight member being dimensioned to extend above said attachment receptor providing enhanced optical recognition.

7. The apparatus of claim 1, further comprising:

said vertical sight member including color reveals for optical recognition of correct sight to target alignment.

8. The apparatus of claim 1, further comprising:

said vertical sight member including a generally horizontal T shaped top, said T shaped top being complementary to, and aligned with, said gun rear sight.

9. The apparatus of claim 8, further comprising:

said T shaped top including means for providing light guided sighting.

10. The apparatus of claim 1, wherein said interchangeable attachments further comprise:

a generally rectangular vertical sight member, said vertical sight member being secured within said central recess and alignment slot;

said vertical sight member having a generally circular top sight extending above said attachment receptor, said vertical sight member and circular top sight for complementary alignment with a gun having a front sight with said gun rear sight removed.

11. A modular rear sight system and back plate receptacle for guns having a slide with a gun rear sight and rear back plate section for receiving a cover plate, comprising:

a back plate receptacle, said back plate receptacle having a mounting base and an attachment receptor;

said mounting base for fitted engagement with said slide rear back plate section;

said attachment receptor for receiving an adjustable sight attachment; and an adjustable sight attachment for fitted engagement within said attachment receptor;

wherein said attachment receptor further comprises:

a central recess and an alignment slot for receiving said adjustable sight attachment in fitted engagement, said adjustable sight attachment being inserted and secured therein;

said central recess having a lower recessed channel;

said adjustable sight attachment having a protruding base flange, said protruding base flange for fitted engagement with said lower recessed channel; and means for adjusting the height of said adjustable sight attachment within said central recess and said alignment slot.

12. The apparatus of claim 11, wherein said adjustable sight attachment further comprises:

a generally rectangular vertical sight member, said vertical sight member being secured within said central recess and alignment slot;

said vertical sight member being complementary to said gun rear sight and aligned therewith.

* * * * *